US010520874B2

(12) United States Patent
Hagimoto

(10) Patent No.: US 10,520,874 B2
(45) Date of Patent: Dec. 31, 2019

(54) CLEANING BLADE AND IMAGE FORMING APPARATUS INCLUDING CLEANING BLADE

(71) Applicant: KONICA MINOLTA, INC., Chiyoda-ku, Tokyo (JP)

(72) Inventor: Noritoshi Hagimoto, Toyohashi (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/251,300

(22) Filed: Jan. 18, 2019

(65) Prior Publication Data

US 2019/0235437 A1 Aug. 1, 2019

(30) Foreign Application Priority Data

Feb. 1, 2018 (JP) ..... 2018-016344

(51) Int. Cl.
*G03G 21/00* (2006.01)

(52) U.S. Cl.
CPC ..... *G03G 21/0017* (2013.01); *G03G 21/0029* (2013.01); *G03G 2221/0005* (2013.01)

(58) Field of Classification Search
CPC ..... G03G 21/0017; G03G 21/0029; G03G 2221/0005
See application file for complete search history.

(56) References Cited

U.S. PATENT DOCUMENTS

2007/0201917 A1* 8/2007 Teshigawara ..... G03G 21/0017 399/350
2010/0247188 A1* 9/2010 Fukuda ..... G03G 21/0017 399/350
2014/0233998 A1* 8/2014 Watanabe ..... G03G 21/0017 399/350

FOREIGN PATENT DOCUMENTS

JP 2005309383 A 11/2005
JP 2007323026 A 12/2007
JP 2008122821 A 5/2008
JP 2014115528 A 6/2014
JP 2014170118 A 9/2014

* cited by examiner

*Primary Examiner* — Sandra Brase
(74) *Attorney, Agent, or Firm* — Buchanan Ingersoll & Rooney PC

(57) ABSTRACT

A cleaning blade that removes a foreign matter adhering to a rotational body includes: an abutment member; a supporting member that supports the abutment member; and a holding member that holds the supporting member, wherein the abutment member includes: an abutment layer abutting on the rotational body; and an adjustment layer that is a part other than the abutment layer, and an elongation percentage of the adjustment layer is larger than an elongation percentage of the abutment layer in a case where frictional force is applied from the rotational body to the abutment member during rotation of the rotational body.

15 Claims, 14 Drawing Sheets

FIG. 17

| | | PHYSICAL PROPERTIES | | | | | | STRUCTURE | VERIFICATION 1 | VERIFICATION 2 | VERIFICATION 3 | VERIFICATION 4 | VERIFICATION 5 |
|---|---|---|---|---|---|---|---|---|---|---|---|---|---|
| | | INTEGRATED VALUE | 100%M | 200%M | HARDNESS | YOUNG MODULUS | ELONGATION AFTER FRACTURE | THICKNESS | PULLED AMOUNT | NON-UNIFORMITY IN WEAR | CLEANING PERFORMANCE | EDGE DAMAGE | PERMANENT DISTORTION |
| EXAMPLE 1 | ABUTMENT LAYER | 300MPa·% | 7MPa | 11MPa | 80° | 12MPa | 370% | 0.5mm | A | B | B | B | B |
| | ADJUSTMENT LAYER | 250MPa·% | 5MPa | 9MPa | 70° | 8.5MPa | 330% | 1.5mm | | | | | |
| EXAMPLE 2 | ABUTMENT LAYER | 250MPa·% | 5MPa | 9MPa | 70° | 8.5MPa | 330% | 0.5mm | A | B | B | C | B |
| | ADJUSTMENT LAYER | 200MPa·% | 3.5MPa | 7MPa | 72° | 7MPa | 350% | 1.5mm | | | | | |
| EXAMPLE 3 | ABUTMENT LAYER | 270MPa·% | 6MPa | 13MPa | 75° | 10MPa | 290% | 0.5mm | A | B | B | C | B |
| | ADJUSTMENT LAYER | 250MPa·% | 5MPa | 9MPa | 70° | 8.5MPa | 330% | 1.5mm | | | | | |
| EXAMPLE 4 | ABUTMENT LAYER | 300MPa·% | 7MPa | 11MPa | 80° | 12MPa | 370% | 1.5mm | B | B | B | B | B |
| | ADJUSTMENT LAYER | 250MPa·% | 5MPa | 9MPa | 70° | 8.5MPa | 330% | 0.5mm | | | | | |
| EXAMPLE 5 | ABUTMENT LAYER | 300MPa·% | 7MPa | 11MPa | 80° | 12MPa | 370% | 0.8mm | B | B | B | B | B |
| | ADJUSTMENT LAYER | 200MPa·% | 3.5MPa | 7MPa | 72° | 7MPa | 350% | 1.2mm | | | | | |
| COMPARATIVE EXAMPLE 1 | ABUTMENT LAYER | 200MPa·% | 3.5MPa | 7MPa | 72° | 7MPa | 350% | 0.5mm | F | F | F | B | B |
| | ADJUSTMENT LAYER | 300MPa·% | 7MPa | 11MPa | 80° | 12MPa | 370% | 1.5mm | | | | | |
| COMPARATIVE EXAMPLE 2 | ABUTMENT LAYER | 200MPa·% | 3.5MPa | 7MPa | 72° | 7MPa | 350% | 0.5mm | F | F | F | B | B |
| | ADJUSTMENT LAYER | 250MPa·% | 5MPa | 9MPa | 70° | 8.5MPa | 330% | 1.5mm | | | | | |
| COMPARATIVE EXAMPLE 3 | ABUTMENT LAYER | 300MPa·% | 7MPa | 11MPa | 80° | 12MPa | 370% | 2mm | F | F | F | B | B |
| | ADJUSTMENT LAYER | – | – | – | – | – | – | – | | | | | |
| COMPARATIVE EXAMPLE 4 | ABUTMENT LAYER | 200MPa·% | 3.5MPa | 7MPa | 72° | 7MPa | 350% | 2mm | A | B | F | F | B |
| | W/O ADJUSTMENT LAYER | – | – | – | – | – | – | – | | | | | |
| COMPARATIVE EXAMPLE 5 | ABUTMENT LAYER | 300MPa·% | 6MPa | 11MPa | 80° | 12MPa | 370% | 2mm | A | B | F | F | F |
| | W/O ADJUSTMENT LAYER | – | – | – | – | – | – | – | | | | | |

FIG. 18

| | |
|---|---|
| ABUTMENT MEMBER | TOTAL THICKNESS: 2mm, LENGTH: 5mm, WIDTH: 340mm |
| SUPPORTING MEMBER | MATERIAL: SUS304, THICKNESS: 80$\mu$m, WIDTH: 340mm |
| HOLDING MEMBER | MATERIAL: SECC STEEL PLATE, THICKNESS: 2$\mu$m, WIDTH: 340mm |
| FIXING METHOD BETWEEN ABUTMENT MEMBER AND SUPPORTING MEMBER | ENTIRE LOWER SURFACE OF ABUTMENT MEMBER IS BONDED USING THERMOPLASTIC BONDING AGENT |
| FIXING METHOD BETWEEN SUPPORTING MEMBER AND HOLDING MEMBER | FIXING BY SPOT WELDING AT A PLURALITY OF FIXING POINTS<br>INTERVAL BETWEEN RESPECTIVE FIXING POINTS IN LONGITUDINAL DIRECTION: 4mm<br>(DISTANCE BETWEEN FIXING POINT AT END IN LONGITUDINAL DIRECTION AND END IN LONGITUDINAL DIRECTION OF SUPPORTING MEMBER: 2mm) |
| FREE LENGTH | 14mm |
| SETTING CONDITIONS | ABUTMENT PRESSURE: 30N/m, EXECUTION ABUTMENT ANGLE ($\theta$): 15° |
| IMAGE CARRIER | ORGANIC PHOTORECEPTOR |

CLEANING BLADE AND IMAGE FORMING APPARATUS INCLUDING CLEANING BLADE

The entire disclosure of Japanese patent Application No. 2018-016344, filed on Feb. 1, 2018, is incorporated herein by reference in its entirety.

BACKGROUND

Technological Field

The present invention relates to a cleaning blade and an image forming apparatus including the cleaning blade. More specifically, the present invention relates to a cleaning blade that removes a foreign matter adhering to a rotational body, and an image forming apparatus including the cleaning blade.

Description of the Related Art

An electrophotographic image forming apparatus includes: a multi-function peripheral (M P) having a scanner function, a facsimile function, a copy function, a function as a printer, a data communication function, and a server function; a facsimile machine; a copy machine; a printer; and the like.

An image forming apparatus generally forms an image on a sheet by the following method. The image forming apparatus forms an electrostatic latent image on an image carrier and develops the electrostatic latent image using a development device to form a toner image Next, the image forming apparatus transfers the toner image to a sheet, and fixes the toner image onto the sheet by a fixing device. Additionally, among image forming apparatuses, there is an image forming apparatus that forms a toner image on a photoreceptor, transfers the toner image to an intermediate transfer belt by using a primary transfer roller, and secondarily transfers, to a sheet, the toner image on the intermediate transfer belt by using a secondary transfer roller.

The image forming apparatus is provided with a cleaning blade that removes residual toner from the image carrier by the blade abutting on the image carrier being rotated. Generally, the cleaning blade is made of a polyurethane elastomer. Since the polyurethane elastomer has an appropriate elasticity, the cleaning blade made of the polyurethane elastomer has a good cleaning property.

On the other hand, the cleaning blade made of the polyurethane elastomer has problems as follows.

The cleaning blade constantly abuts on the image carrier. When the polyurethane elastomer is degraded with time, there is a problem in which permanent distortion (permanent set) occurs in the cleaning blade due to force received from the image carrier, and pressure (abutment pressure) with which the cleaning blade abuts on the image carrier is decreased due to the permanent distortion. Such decrease in the abutment pressure of the cleaning blade causes cleaning failure. Additionally, in a case of setting high abutment pressure in an initial stage of use of the cleaning blade in order to compensate for the decrease in the abutment pressure of the cleaning blade caused by time degradation of the polyurethane elastomer, the high abutment pressure of the cleaning blade hinders rotation of the image carrier and causes increase in torque required to rotate the image carrier.

Additionally, performance of the cleaning blade made of the polyurethane elastomer is largely changed depending on an environment. In other words, the abutment pressure is increased and the torque required to rotate the image carrier is increased in a high-temperature environment, and the abutment pressure is decreased in a low-temperature environment. Accordingly, the abutment pressure is set at a high value such that required abutment pressure can be ensured in the low-temperature environment. As a result, the torque required to rotate the image carrier is increased.

Furthermore, due to the characteristics of the polyurethane elastomer, when an edge of the cleaning blade abutting on the image carrier is pulled toward a downstream side in a rotational direction of the image carrier, the cleaning blade is deformed and the abutment pressure is increased. As a result, the torque required to rotate the image carrier is increased.

A technique that can solve the above-described problem of the cleaning blade made of the polyurethane elastomer is disclosed in JP 2007-323026 A and the like. The cleaning blade disclosed in JP 2007-323026 A includes: an elastic body which abuts on an image carrier and is made of urethane rubber or the like; a metallic leaf spring that supports the elastic body; and a holding metal plate that holds the leaf spring. An end of the leaf spring protrudes from the holding metal plate, and the elastic body is supported by this part of the leaf spring protruding from the holding metal plate. According to the cleaning blade of JP 2007-323026 A, since the elastic body that abuts on the image carrier and the leaf spring that supports the elastic body are constituted of separate members, an optimum material can be selected as a material of the leaf spring in the viewpoint of reducing change in performance due to time degradation or depending on an environment.

JP 2008-122821 A, JP 2005-309383 A, JP 2014-115528 A, JP 2014-170118 A, and the like also disclose structures of cleaning blades, respectively. JP 2008-122821 A discloses a technique of the cleaning blade including an elastic layer formed on one face of a metal plate, in which the elastic layer has a multilayer structure including: a cleaning layer that abuts on an object to be cleaned; and a backup layer other than the cleaning layer. At least one of a Young's modulus or hardness of the backup layer is larger than a Young's modulus or hardness of the cleaning layer.

JP 2005-309383 A discloses a cleaning device including: a blade that removes residual toner from a surface of an image carrier by a plate edge abutting on the surface of the image carrier; an auxiliary member which covers a rear surface not facing the image carrier out of front and rear surfaces of the blade, and suppresses permanent deflection of the blade; and a supporting member which is interposed between a main body casing and the auxiliary member and supports the blade with respect to the main body casing in cooperation with the auxiliary member. The supporting member includes an elastic member at least in part, and receives stress caused by the blade abutting on the image carrier.

JP 2014-115528 A and JP 2014-170118 A each disclose a cleaning device including an elastic blade. The elastic blade is an edge layer having an end ridge part and includes, at 23° C.: an edge layer in which a 100% modulus value is 6 MPa or more; and a backup layer in which a 100% modulus value is lower than 100% modulus value of the edge layer.

In a cleaning blade disclosed in JP 2007-323026 A, an elastic body is fixed to a metallic leaf spring by using a bonding agent or the like. An interval between the leaf spring and the elastic body can be hardly kept uniform in a longitudinal direction of the cleaning blade (extending direction of a rotational shaft of an image carrier), and there is unevenness in a height of the elastic body in the longitudinal direction of the cleaning blade in the vicinity of an end of a protruding part of the leaf spring. As a result, a state of the cleaning blade abutting on the image carrier becomes non-uniform in the longitudinal direction of the cleaning blade, and the abutment pressure becomes uneven.

When the abutment pressure of the cleaning blade to the image carrier is uneven, there are two problems as follows.

The first problem due to the unevenness in the abutment pressure is non-uniformity in density caused by non-uniformity in wear of the image carrier. When the abutment pressure becomes uneven, the image carrier is seriously worn away in a region where the abutment pressure is high, and the image carrier is worn little in a region where the abutment pressure is low. When there is a difference between the region with serious wear and the region with little wear, non-uniformity in density is caused. In other words, in a case where the image carrier is a photoreceptor, a charge amount of the photoreceptor is varied by a thickness of a photosensitive layer of the photoreceptor. A charging method is different depending on a charging system, however; in a case where the charging system of the photoreceptor is a corona charging system, for example, negative ions accumulated on a thin part of the photosensitive layer are few, and potential in the thin part of the photosensitive layer is lower in potential in other parts. Additionally, in a case where the charging system of the photoreceptor is a proximity charging system such as roller charging, electrostatic capacity in the thin part of the photosensitive layer is larger than electrostatic capacity in other parts, and the potential in the thin part of the photosensitive layer is higher than the potential in other parts. When the potential becomes uneven, a toner amount used for development becomes different, and density becomes non-uniform.

The second problem caused by the unevenness in the abutment pressure is cleaning failure. The cleaning failure is mainly caused by decrease in the abutment pressure of the cleaning blade to the image carrier. Normally, the abutment pressure is decreased by: abrasion of an end of the cleaning blade due to increase in the number of printed sheets; and permanent distortion of the cleaning blade due to time degradation. In the cleaning blade having the structure in which the elastic body is supported by the leaf spring like JP 2007-323026 A, the abutment pressure in an initial stage of use can be set low. Therefore, an abrasion speed of the end of the cleaning blade is slower than an abrasion speed in other structures, and permanent distortion of the cleaning blade due to time degradation is smaller than in other structures. However, in a case where there is unevenness in the abutment pressure, the abutment pressure may become lower than the abutment pressure required for cleaning in a part in the longitudinal direction of the cleaning blade and cleaning failure occurs when the cleaning blade is further abraded.

The unevenness in the abutment pressure is not caused only by unevenness in a height of the cleaning blade due to bonding but also by a fact that the metallic leaf spring and urethane rubber are fixed in the first place. The metallic leaf spring is flexible, but a deflection direction is only a direction in which the abutment pressure is applied, and substantially the leaf spring has a characteristic of a rigid body with respect to the rotational direction of the photoreceptor. An end of the urethane rubber (on an opposite side of the edge) is fixed to the metallic leaf spring and substantially restrained. In this state, a pulled amount is small. A fact of having a small pulled amount provides effects of causing little deformation, suppressing increase in torque, and suppressing degradation of the urethane caused by deformation of the edge, but there is also a harmful effect in which unevenness in the abutment pressure cannot be absorbed. For example, even in a case where there is unevenness in the same height, when the pulled amount is small, a proportion of unevenness in the height relative to the pulled amount is high, and unevenness in the abutment pressure is increased. In a cleaning blade made of only the urethane rubber in the related art, even when there is unevenness in a height of the urethane rubber, a pulled amount is large because the urethane rubber is not restrained to the metallic leaf spring, and also a proportion of unevenness in the height of the urethane rubber relative to the pulled amount is low and unevenness in the abutment pressure is little. Therefore, the unevenness in the height of the elastic body in the longitudinal direction of the cleaning blade is a problem peculiar to the cleaning blade in which the abutment member is supported by the supporting member.

The above-described problem may occur not only in a cleaning blade that removes a foreign matter adhering to an image carrier but also in all of general cleaning blades that remove foreign matters adhering to a rotational body.

SUMMARY

The present invention is made in view of the above-described problems and an object of the present invention is to provide: a cleaning blade that can suppress unevenness in abutment pressure applied to a rotational body; and an image forming apparatus including the cleaning blade.

To achieve the abovementioned object, according to an aspect of the present invention, a cleaning blade that removes a foreign matter adhering to a rotational body reflecting one aspect of the present invention comprises: an abutment member; a supporting member that supports the abutment member; and a holding member that holds the supporting member, wherein the abutment member includes: an abutment layer abutting on the rotational body; and an adjustment layer that is a part other than the abutment layer, and an elongation percentage of the adjustment layer is larger than an elongation percentage of the abutment layer in a case where frictional force is applied from the rotational body to the abutment member during rotation of the rotational body

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 17 is a table illustrating structures of Examples 1 to 5 of the present invention in a first practical example of the present invention and Comparative Examples 1 to 5, and verification results thereof;

FIG. 18 is a table illustrating various conditions in the first practical example of the present invention;

DETAILED DESCRIPTION OF EMBODIMENTS

Hereinafter, one or more embodiments of the present invention will be described with reference to the drawings. However, the scope of the invention is not limited to the disclosed embodiments.

In the following embodiment, a case where an image forming apparatus mounted with a cleaning blade is an MFP will be described. The image forming apparatus mounted with the cleaning blade may not necessarily be the MFP but may also be a facsimile machine, a copying machine, a printer, or the like.

[Structure of Image Forming Apparatus]

First, a structure of an image forming apparatus according to the present embodiment will be described.

Figure 1:
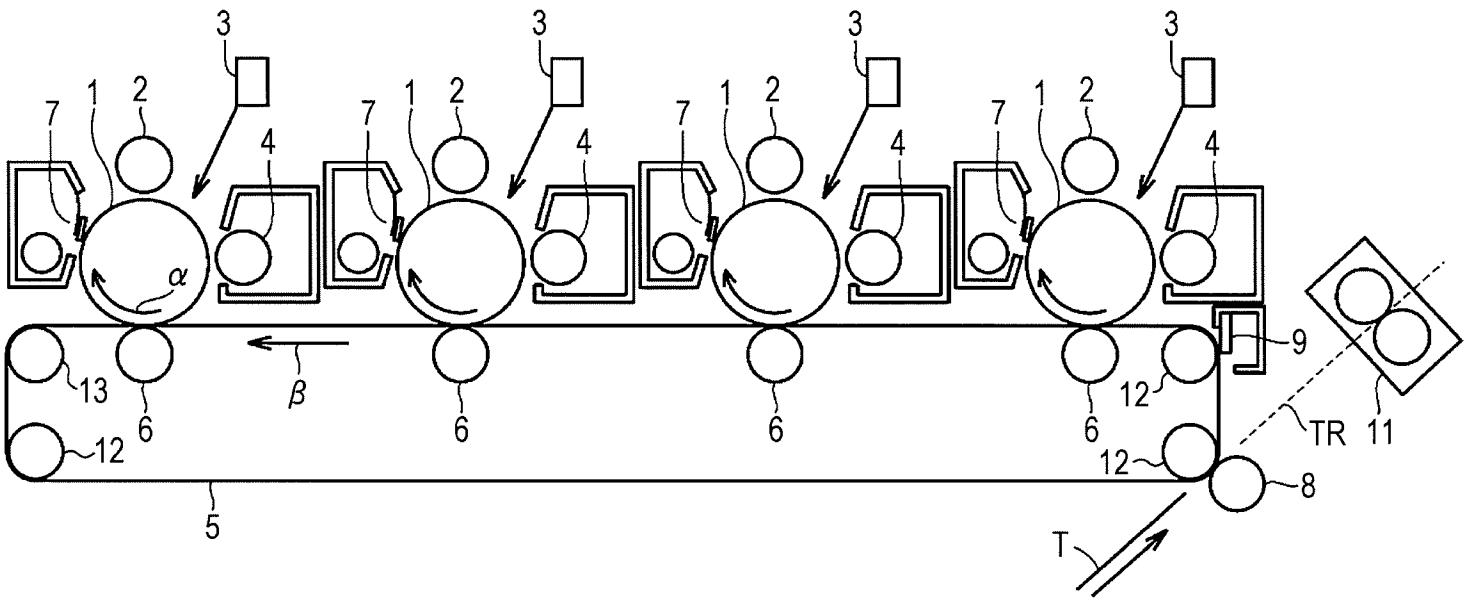
FIG. 1 is a cross-sectional view illustrating a structure of a main part of an image forming apparatus according to an embodiment of the present invention.

FIG. 1 is a cross-sectional view illustrating a structure of a main part of the image forming apparatus according to an embodiment of the present invention.

Referring to FIG. 1, the image forming apparatus in the present embodiment is a full-color tandem type image forming apparatus. The image forming apparatus forms an image by transferring and fixing, to a recording medium T such as a sheet, a toner image formed on a photoreceptor 1 by an electrophotographic image forming process. The image forming apparatus includes the photoreceptor 1 (an example of a rotational body and an image carrier), a charging member 2, an exposure member 3, a development device 4, an intermediate transfer belt 5, a primary transfer roller 6, a photoreceptor cleaner 7, a secondary transfer roller 8, an intermediate transfer belt cleaner 9, a fixing member 11, and support rollers 12.

The photoreceptor 1, charging member 2, exposure member 3, development device 4, primary transfer roller 6, and photoreceptor cleaner 7 are provided for each of toner colors yellow (Y), magenta (M), cyan (C), and black (K). The charging member 2, exposure member 3, development device 4, and photoreceptor cleaner 7 are arranged in this order around the photoreceptor 1 along a rotational direction (indicated by an arrow α) of the photoreceptor 1. The intermediate transfer belt 5 is provided below the photoreceptor 1 and is rotated in a direction indicated by an arrow β. The primary transfer roller 6 faces the photoreceptor 1 via the intermediate transfer belt 5.

The secondary transfer roller 8 is arranged at a position on the intermediate transfer belt 5, and the position is located more on a downstream side in the rotational direction of the intermediate transfer belt 5 than the primary transfer roller 6 of each of the colors is. The secondary transfer roller 8 faces a predetermined support roller 12 interposing the intermediate transfer belt 5. The intermediate transfer belt cleaner 9 is arranged at a position on the intermediate transfer belt 5, and the position is located more on the downstream side in the rotational direction of the intermediate transfer belt 5 than a position facing the secondary transfer roller 8 is.

Each of the plurality of support rollers 12 is arranged in parallel to each other, and applies constant tension to the intermediate transfer belt 5. One support roller 13 out of the plurality of support rollers 12 is rotationally driven, thereby rotating the intermediate transfer belt 5. Other support rollers 12 are rotated following the intermediate transfer belt 5. The fixing member 11 is arranged on a conveyance route TR and located more on a downstream side than the secondary transfer roller 8 is.

The photoreceptor 1 carries an electrostatic latent image on a surface layer thereof. The charging member 2 uniformly charges a surface of the photoreceptor 1. The exposure member 3 exposes an image-corresponding part of the surface of the photoreceptor 1 to form an electrostatic latent image. The development device 4 develops the electrostatic latent image on the surface of the photoreceptor 1 with charged toner by action of electric field force. The primary transfer roller 6 transfers, onto the intermediate transfer belt 5, the toner image formed on the surface of the photoreceptor 1 by action of electric field force. The photoreceptor cleaner 7 removes toner (transfer residual toner) remaining on the surface of the photoreceptor 1.

Toner images of the respective Y, M, C, and K colors are transferred to the surface of the intermediate transfer belt 5 in a superimposed manner, and conveyed to the position facing the secondary transfer roller 8. On the other hand, a recording medium T is conveyed to the secondary transfer roller 8 along the conveyance route TR by a conveyor not illustrated.

The secondary transfer roller 8 transfers, to the recording medium T, the toner images of Y, M, C, and K having been transferred to the surface of the intermediate transfer belt 5 by action of electric field force. The recording medium T to which the toner images have been transferred is heated and pressed by the fixing member 11. Consequently, the toner images are fixed to the recording medium T. After that, the recording medium T is conveyed along the conveyance route TR and ejected to the outside of the image forming apparatus. The intermediate transfer belt cleaner 9 abuts on the intermediate transfer belt 5, and removes (cleans) the toner (transfer residual toner) remaining on the surface of the intermediate transfer belt 5.

The above-described structure of the image forming apparatus is an example. The constituent elements such as the photoreceptor, charging member, exposure member, development device, cleaner, transfer member, and fixing member in the image forming apparatus may also be used while arbitrarily selecting a known electrophotographic technique.

Subsequently, a structure of the photoreceptor cleaner 7 in the present embodiment will be described.

Figure 2:
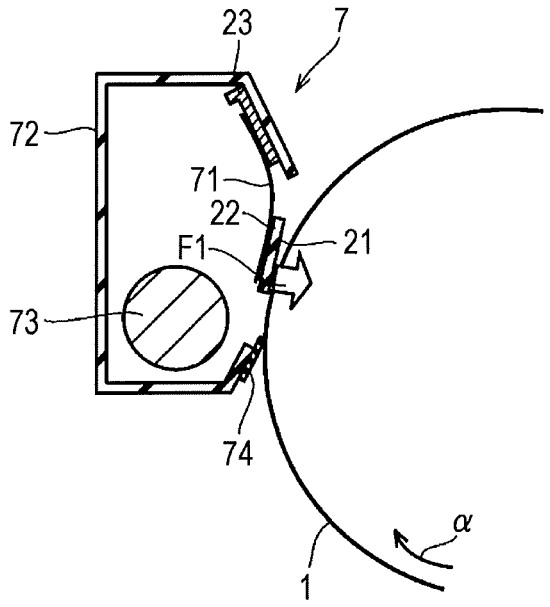
FIG. 2 is a cross-sectional view illustrating a structure of a photoreceptor cleaner according to an embodiment of the present invention.

FIG. 2 is a cross-sectional view illustrating a structure of the photoreceptor cleaner 7 according to an embodiment of the present invention. In FIG. 2, the photoreceptor 1 is illustrated for convenience of description.

Referring to FIG. 2, the photoreceptor cleaner 7 includes a cleaning blade 71, a housing 72, a screw 73, and a toner seal member 74. The cleaning blade 71 abuts on the photoreceptor 1, and removes residual toner (transfer residual toner) that is a foreign matter adhering to the photoreceptor 1. The housing 72 is adapted to house the residual toner removed by the cleaning blade 71, and houses the cleaning blade 71 and the screw 73. The screw 73 conveys the residual toner removed by the cleaning blade 71 to a waste toner storage box not illustrated. The toner seal member 74 prevents the removed residual toner from being scattered to a periphery of the photoreceptor 1 by sealing the inside of the housing 72, and prevents contamination of the surface of the photoreceptor 1.

The cleaning blade 71 includes an abutment member 21 that abuts on the photoreceptor 1, a supporting member 22 that supports the abutment member 21, and a holding member 23 that holds the supporting member 22. The holding member 23 is fixed to the housing 72. Since the supporting member 22 acts as a leaf spring, the abutment member 21 abuts on the photoreceptor 1 with necessary abutment pressure. With this structure, the transfer residual toner on the surface of the photoreceptor 1 after primary transfer is scraped off and removed by the abutment member 21. The abutment member 21 abuts on the photoreceptor 1 in a direction indicated by an arrow F1. The abutment member 21 has an abutment function to abut on the photoreceptor 1. The supporting member 22 has a supporting function to support the abutment member 21 in the cleaning blade 71.

[Structure of Cleaning Blade]

Subsequently, a structure of the cleaning blade in the present embodiment will be described.

Figure 3:
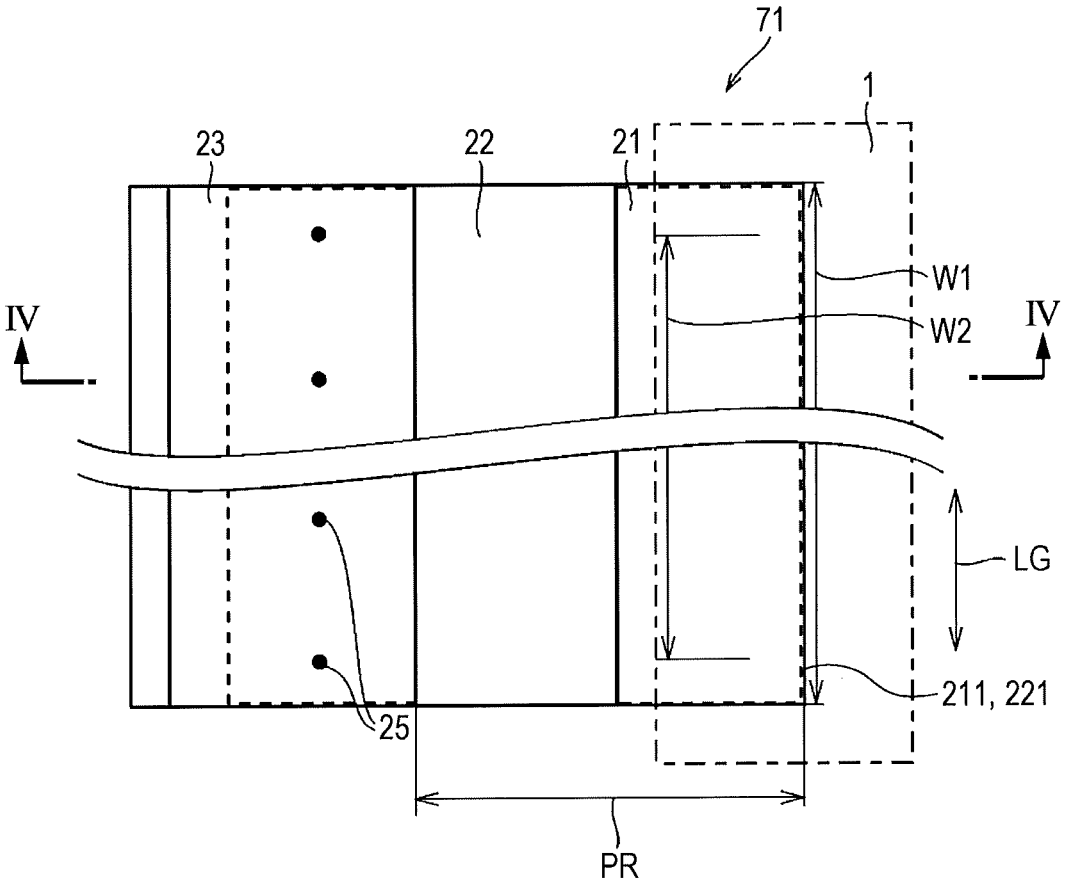
FIG. 3 is a top view illustrating a structure of a cleaning blade according to an embodiment of the present invention.
Figure 4:
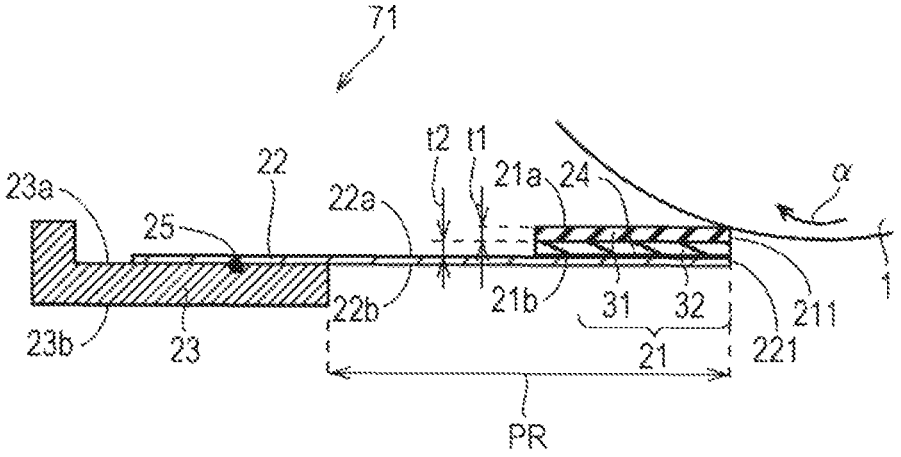
FIG. 4 is an example of a cross-sectional view taken along a line IV-IV in FIG. 3.

FIG. 3 is a top view illustrating the structure of the cleaning blade 71 according to an embodiment of the present invention. FIG. 4 is an example of a cross-sectional view taken along a line IV-IV in FIG. 3. In FIGS. 3 and 4, the photoreceptor 1 is illustrated for convenience of description, and the supporting member 22 is illustrated not in a non-deflected state. Actually, the supporting member 22 is deflected by force received from the photoreceptor 1.

In the following description, an end (right end in FIG. 3) of the cleaning blade 71 close to the photoreceptor 1 may be referred to as a leading end, and an end (left end in FIG. 3) of the cleaning blade 71 far from the photoreceptor 1 in FIG. 3 may be referred to as a rear end.

Referring to FIGS. 3 and 4, the abutment member 21 has a plate-like shape and has a rectangular shape when viewed from above. The abutment member 21 includes: an upper surface 21*a* that is a flat surface; and a lower surface 21*b* that is a flat surface located on an opposite side of the upper surface 21*a* . The abutment member 21 abuts on the photoreceptor 1 in the vicinity of an edge that is a boundary between the upper surface 21*a* and a leading end 211, and the lower surface 21*b* of the abutment member is supported by the supporting member 22.

The abutment member 21 is constituted of an elastic body. Specifically, the abutment member 21 is made of urethane rubber, fluoro rubber (FKM), styrene butadiene rubber (SBR), acrylonitrile butadiene rubber (NBR), or the like. The abutment member 21 is preferably made of a material excellent in abrasion resistance and ozone resistance. The abutment member 21 preferably has a thickness (length in a vertical direction in FIG. 4) of 0.5 mm or more and 2.0 mm or less.

The abutment member 21 includes an abutment layer 31 and an adjustment layer 32. The abutment layer 31 abuts on the photoreceptor 1. The adjustment layer 32 is a part of the abutment member 21 other than the abutment layer 31. An elongation percentage of the adjustment layer 32 is larger than an elongation percentage of the abutment layer 31 in a case where frictional force is applied from the photoreceptor 1 to the abutment member 21 during rotation of the photoreceptor 1.

In the present embodiment, the abutment layer 31 and the adjustment layer 32 are laminated in a predetermined lamination direction (here, direction perpendicular to an upper surface 22*a* of the supporting member 22, namely, the vertical direction in FIG. 4). The adjustment layer 32 is arranged closer to the supporting member 22 than the abutment layer 31 is, and the adjustment layer 32 is fixed to the supporting member 22 with a bonding agent 24. The abutment layer 31 is not fixed to the supporting member 22. Since the adjustment layer 32 is bonded to the supporting member 22, it is possible to suppress unevenness in the abutment pressure at a position farther from the edge (the boundary between the leading end 211 and the upper surface 21*a* ). In a case of defining a thickness of the abutment layer 31 in the lamination direction as a thickness t1 and defining a thickness of the adjustment layer 32 in the lamination direction as a thickness t2, it is preferable that the thickness t1 and t2 have a relation of $t1<t2$.

In the present embodiment, since the abutment member 21 is constituted of the abutment layer 31 and the adjustment layer 32, the abutting function and the supporting function owned by the abutment member 21 are exerted by the abutment layer 31 and the adjustment layer 32 respectively. In other words, the abutment layer 31 has the edge that abuts on the photoreceptor 1, and has the abutting function to abut on the photoreceptor 1. The abutting function includes: a cleaning property to block the residual toner with the edge; abrasion resistance to perform cleaning for a long period of time; a function to abut on the photoreceptor 1 without damaging the photoreceptor 1; and the like. The adjustment layer 32 has an adjustment function to suppress unevenness in the abutment pressure of the cleaning blade 71 to the photoreceptor 1.

A length W1 of the abutment member 21 (length in the rotational axis direction of the photoreceptor 1) along a longitudinal direction of the cleaning blade 71 (direction indicated by an arrow LG in FIG. 3) is longer than a length W2 of an image forming region of the photoreceptor 1. In a case where the cleaning blade 71 is molded with a metal mold, the thickness and the length W1 of the abutment member 21 may be smaller than the above-mentioned ranges. The length of the abutment member 21 along a short direction of the cleaning blade 71 (direction indicated by an arrow PR in FIG. 3) is preferably 5 mm or more and 10 mm or less.

The abutment member 21 may be fixed to the supporting member 22 also with a double-sided tape or the like. From the viewpoint of securing straightness of the supporting member 22, it is preferable that the abutment member 21 be fixed to the supporting member 22 with the bonding agent 24. As the bonding agent 24, a thermoplastic bonding agent is preferable. Additionally, the abutment member 21 may be fixed to the supporting member 22 also by pouring a molten material of the abutment member 21 into a metal mold in a state in which the supporting member 22 is fixed to the metal mold of the abutment member 21 at the time of molding the abutment member 21. In this case, the bonding agent or the double-sided tape becomes unnecessary.

A position of the leading end 211 of the abutment member 21 preferably coincides with a position of a leading end 221 of the supporting member 22. In a case where the leading end 221 of the supporting member 22 protrudes more than the leading end 211 of the abutment member 21, the supporting member 22 preferably does not contact the photoreceptor 1. In a case where the leading end 211 of the abutment member 21 protrudes more than the leading end 221 of the supporting member 22, a protruding length of the abutment member 21 is preferably 0.5 mm or less. With this structure, it is possible to prevent a situation in which the abutment member 21 protruding from the leading end 221 of the supporting member 22 is deformed and the abutment pressure on the photoreceptor 1 is decreased with time.

The supporting member 22 is plate-like shape and has a rectangular shape when viewed from above. The supporting member 22 includes a protrusion PR protruding toward the leading end side from the holding member 23 (protruding in the short direction of the cleaning blade 71). The protrusion PR protrudes from the holding member 23 in a direction opposite to the rotational direction of the photoreceptor 1 (direction indicated by the arrow α). The abutment member 21 is fixed to the leading end 221 of the supporting member 22. The supporting member 22 includes: the upper surface 22*a* (exemplary first supporting member surface) located on the edge side of the abutment member 21 (position where the abutment member 21 abuts on the photoreceptor 1); and a lower surface 22*b* (exemplary second supporting member surface) located on an opposite side of the upper surface 22*a* and facing an upper surface 23*a* of the holding member 23. The abutment member 21 is fixed to the upper surface 22*a* of the supporting member 22.

The supporting member 22 is constituted of a metallic leaf spring or the like. Specifically, the supporting member 22 is made of stainless steel or phosphor bronze having high corrosion resistance. Particularly, the stainless steel is preferable because the stainless steel has high strength and high fatigue strength.

The supporting member 22 preferably has a thickness (length in the vertical direction in FIG. 4) that is larger than 0 and 100 μm or less in order to ensure good followability relative to rotation of the photoreceptor 1. Additionally, the supporting member 22 preferably has a Young's modulus of 98 GPa or more and 206 GPa or less. It is preferable that the structure of the supporting member 22 be selected in consideration of the above-described thickness and Young's modulus.

The holding member 23 holds a part of a rear end side of the supporting member. The holding member 23 has the upper surface 23*a* (exemplary first holding member surface) located on the edge side of the abutment member 21; and a lower surface 23*b* (exemplary second holding member surface) that is a flat surface located on an opposite side of the upper surface 23*a*.

The supporting member 22 is fixed to the upper surface 23*a* of the holding member 23 by a method such as welding, bonding, fastening with a screw, or the like. Here, the structure in which the supporting member 22 is fixed to the holding member 23 by spot welding is illustrated, and a welded part (a position where the supporting member 22 and the holding member 23 are melted and fixed) 25 is located between the supporting member 22 and the holding member 23.

The holding member 23 is constituted of a metal (sheet metal) or the like. Specifically, the holding member 23 is constituted of a steel plate such as steel electrically chromate coated (SECC). Preferably, the holding member 23 has a thickness of 1.6 mm or more and 2.0 mm or less in order to: suppress deformation of the holding member 23 caused by pressure applied to the cleaning blade 71, external force, and the like; and ensure the high edge straightness of the cleaning blade 71.

A distance between the photoreceptor 1 and the abutment member 21 is determined by a position where the cleaning blade 71 is fixed to the housing 72 and an angle of the cleaning blade 71 with respect to the housing 72. Additionally, a free length of the cleaning blade 71 is determined by a position where the supporting member 22 is installed at the holding member 23. Furthermore, a deflection amount of the supporting member 22 is determined by the position where the cleaning blade 71 is fixed to the housing 72.

Effects of Embodiment

Next, effects of the cleaning blade 71 in the present embodiment will be described.

Figure 5:
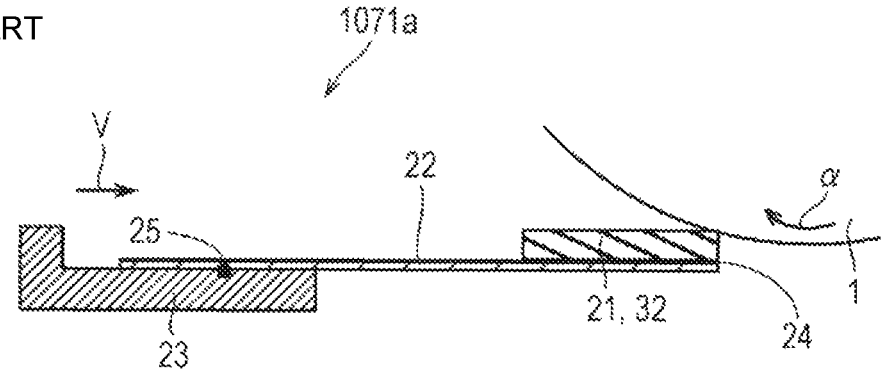
FIG. 5 PRIOR ART
FIG. 5 is a cross-sectional view illustrating a structure of a cleaning blade in a first comparative example.
Figure 6:
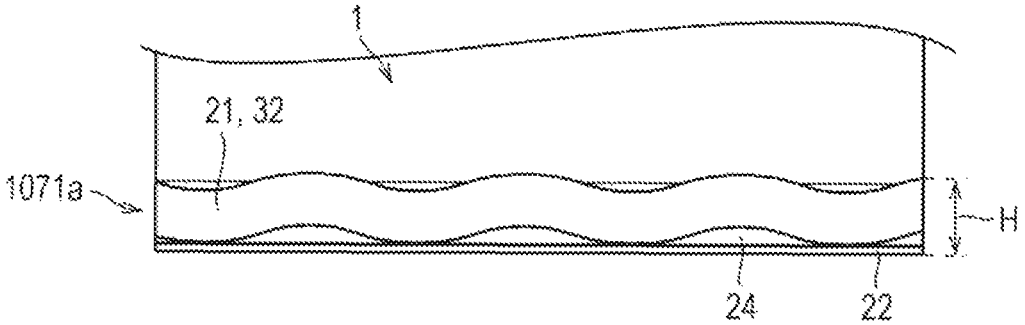
FIG. 6 PRIOR ART
FIG. 6 is a view illustrating the structure of the cleaning blade when viewed from a direction indicated by an arrow V in FIG. 5.

FIG. 5 is a cross-sectional view illustrating a structure of a cleaning blade 1071*a* in a first comparative example. FIG. 6 is a view illustrating the structure of the cleaning blade 1071*a* when viewed from a direction indicated by an arrow V in FIG. 5. Note that, in FIG. 6, unevenness in a height H of the cleaning blade 1071*a* is illustrated in a manner more emphasized than an actual state.

Referring to FIGS. 5 and 6, the cleaning blade 1071*a* in the first comparative example differs from the cleaning blade 71 of the present embodiment in that an abutment member 21 includes only one layer (here, the layer having material quality same as material quality of an adjustment layer 32).

The unevenness in the height H of the cleaning blade 1071*a* is caused as illustrated in FIG. 6 by a state of a bonding agent 24 to bond the abutment member 21 to a supporting member 22, a bonding method at the time of bonding, and the like. When the height H becomes uneven, the abutment pressure is increased in a region where the height H is high, and the abutment pressure is decreased in a region where the height H is low in a case where the abutment member 21 abuts on a photoreceptor 1. As a result, unevenness in the abutment pressure causes non-uniformity in a wear amount of the photoreceptor 1, and density becomes non-uniform in a printed image Additionally, the abutment pressure is decreased in the region where the height H is low, thereby causing cleaning failure. The problem can be suppressed to some extent by improving bonding accuracy between the abutment member 21 and the supporting member 22, but the problem can be hardly solved completely.

Figure 7:
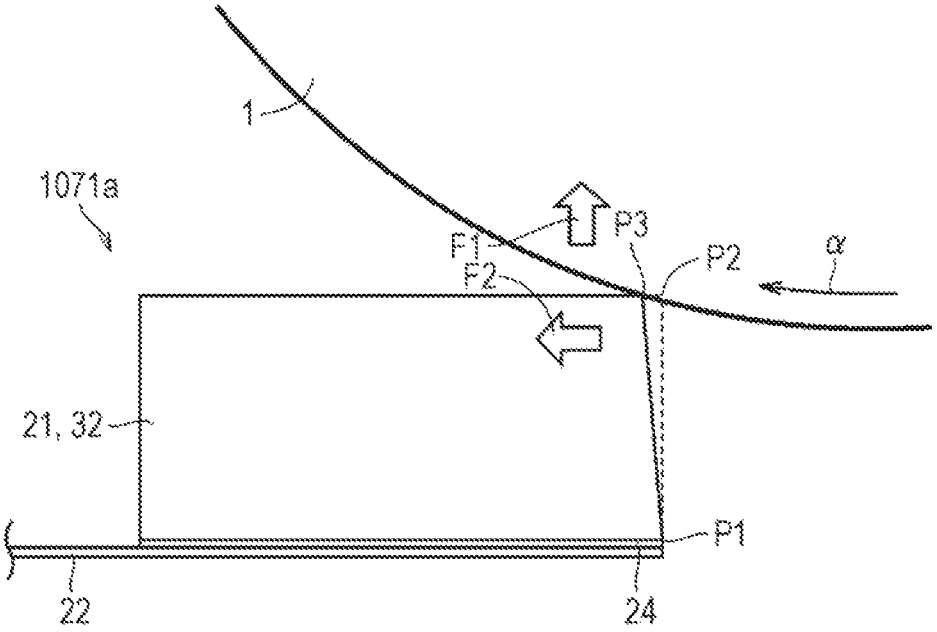
FIG. 7 PRIOR ART
FIG. 7 is a view schematically illustrating a pulled amount of an edge of an abutment member in the cleaning blade of the first comparative example.

FIG. 7 is a view schematically illustrating a pulled amount of an edge of the abutment member 21 in the cleaning blade 1071*a* of the first comparative example.

Referring to FIG. 7, the unevenness in the height H of the cleaning blade 1071*a* is not caused only by bonding but also by fixation of the abutment member 21 to the supporting member 22 despite a fact that the abutment member 21 and the supporting member 22 have different kinds of material quality. As an example, in a case where the supporting member 22 is constituted of a metallic leaf spring, the supporting member 22 has flexibility, but a deflection direction of the supporting member 22 is only a direction opposite to a direction indicated by an arrow F1 (direction in which the abutment pressure is applied to the photoreceptor 1). The supporting member 22 is not deflected in the direction indicated by an arrow F2 (rotational direction of the photoreceptor 1) and exhibits a characteristic of a substantially rigid body.

When the photoreceptor 1 is rotated, frictional force in the direction indicated by the arrow F2 is applied to the cleaning blade 1071*a* , and the edge of the abutment member 21 (position abutting on the photoreceptor 1) is pulled from a position P2 to a position P3. As described above, the supporting member 22 is hardly deflected by the frictional force. Additionally, since the abutment member 21 is fixed to the supporting member 22, and a position P1 at an end on a leading end side of the abutment member 21 is restrained by the supporting member 22. Therefore, the pulled amount of the edge of the abutment member 21 (a distance from the position P2 to the position P3) by rotation of the photoreceptor 1 is small.

When the pulled amount of the edge of the abutment member 21 by rotation of the photoreceptor 1 is small, an effect of suppressing (leveling) the unevenness in the abutment pressure is small. In other words, assuming that the unevenness in the height H of the cleaning blade 1071*a* is constant, when the pulled amount of the edge is large, a proportion of the unevenness in the height H relative to the pulled amount of the edge becomes low and the unevenness in the abutment pressure can be leveled by the pulled amount of the edge, however; when the pulled amount of the edge is small, a proportion of the unevenness in the height H relative to the pulled amount of the edge becomes high and the unevenness in the abutment pressure cannot be leveled by the pulled amount of the edge.

Figure 8:
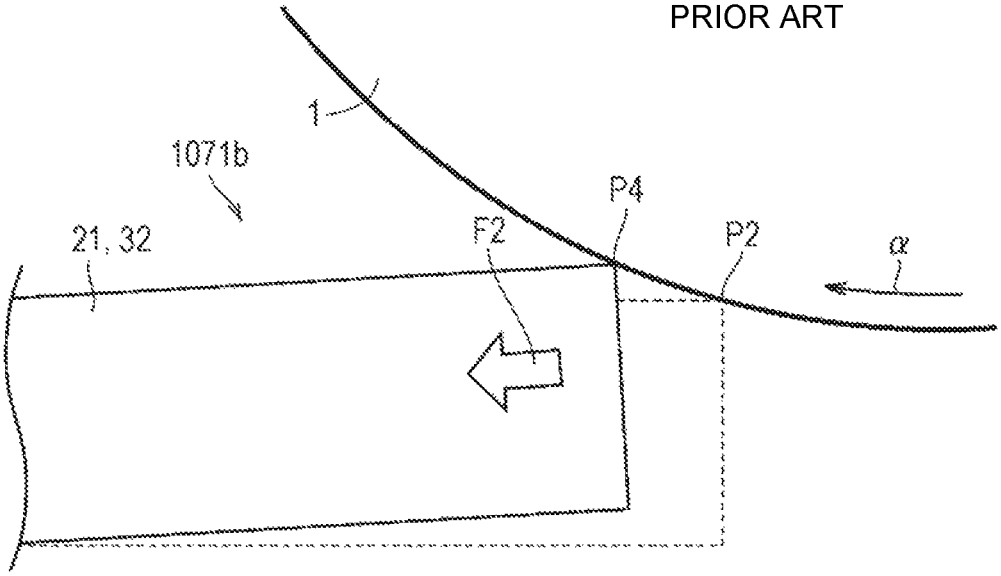
FIG. 8 PRIOR ART
FIG. 8 is a cross-sectional view illustrating a structure of a cleaning blade in a second comparative example.

FIG. 8 is a cross-sectional view illustrating a structure of a cleaning blade 1071*b* in a second comparative example.

Referring to FIG. 8, the cleaning blade 1071*b* in the second comparative example differs from the cleaning blade 71 of the present embodiment in that an abutment member 21 is not supported by a supporting member and includes only one layer (here, the layer having material quality same as material quality of an adjustment layer 32).

When the photoreceptor 1 is rotated, frictional force in a direction indicated by an arrow F2 is applied to the cleaning blade 1071*b* , and an edge of the abutment member 21 (position abutting on the photoreceptor 1) is pulled from a position P2 to a position P4. In the cleaning blade 1071*b* , since the abutment member 21 is not restrained by the supporting member, the pulled amount of the edge of the abutment member 21 (distance from the position P2 to the position P4) by rotation of the photoreceptor 1 is large. Therefore, even when a height H of the cleaning blade 1071*b* is uneven, unevenness in abutment pressure is leveled. Accordingly, the unevenness in the abutment pressure in a longitudinal direction of the cleaning blade is a problem peculiar to the cleaning blade in which the abutment member 21 is supported by the supporting member 22. Meanwhile, in the cleaning blade 1071*b* , there is a problem that permanent distortion tends to occur in the cleaning blade because the abutment member 21 is not supported by the supporting member.

Figure 9:
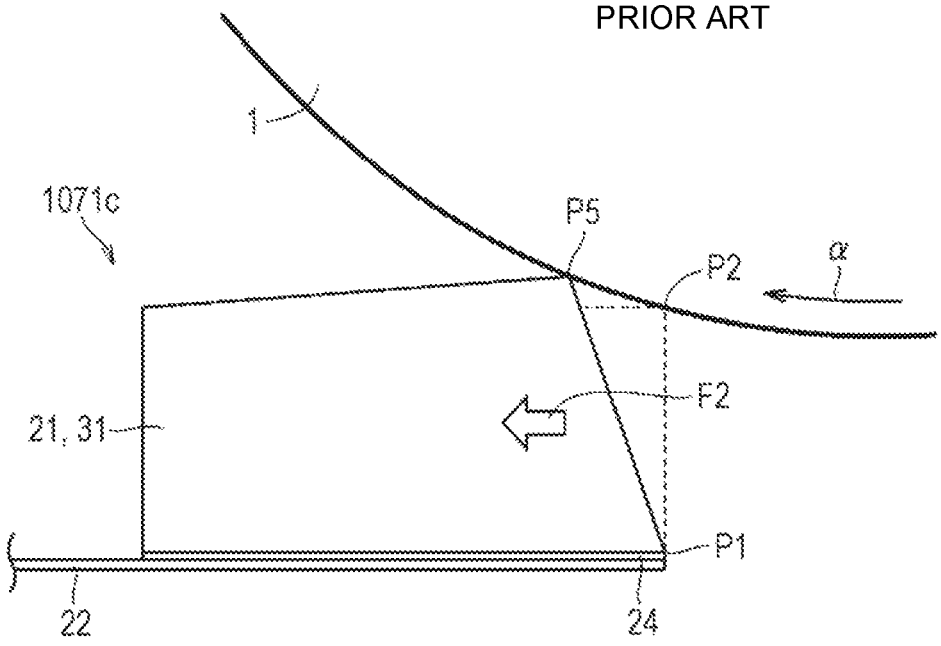
FIG. 9 PRIOR ART
FIG. 9 is a view schematically illustrating a pulled amount of an edge of an abutment member in a cleaning blade of a third comparative example.
Figure 10:
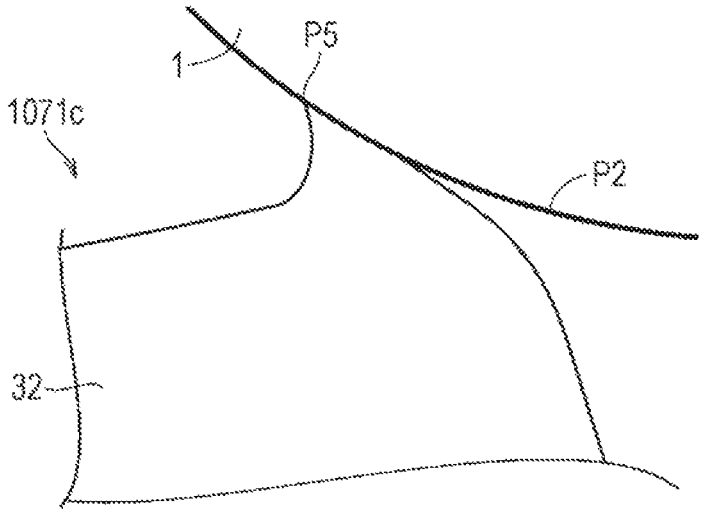
FIG. 10 PRIOR ART
FIG. 10 is an enlarged view of the edge of the abutment member in the cleaning blade illustrated in FIG. 9.

FIG. 9 is a view schematically illustrating a pulled amount of an edge of an abutment member 21 in a cleaning blade 1071*c* of a third comparative example. FIG. 10 is an enlarged view of an edge of the abutment member 21 in the cleaning blade 1071*c* illustrated in FIG. 9.

Referring to FIGS. 9 and 10, the cleaning blade 1071*c* in the third comparative example differs from the cleaning blade 71 of the present embodiment in that the abutment member 21 includes only one layer (here, the layer having material quality same as material quality of an abutment layer 31). In other words, the cleaning blade 1071*c* is obtained by using, as the abutment member 21, a material that can be easily elongated in a conventional cleaning blade in which the abutment member 21 is supported by a supporting member 22.

According to the cleaning blade 1071*c* , an edge of the abutment member 21 is pulled from a position P2 to a position P5 by rotation of a photoreceptor 1, and the pulled amount of the edge of the abutment member 21 (distance from a position P2 to a position P5) by rotation of the photoreceptor 1 can be increased. As a result, even when a height H of the cleaning blade 1071*c* becomes uneven, unevenness in abutment pressure can be leveled.

On the other hand, the cleaning blade 1071*c* has the following problem. In the cleaning blade 1071*c* , in a case where frictional force is applied from the photoreceptor 1 to the abutment member 21 during rotation of the photoreceptor 1, a large load is applied to the entire abutment member 21, and a deformation amount of the abutment member 21 is increased. Consequently, fatigue is accumulated in the abutment member 21 as the number of printed sheets is increased, and the edge of the abutment member 21 is likely to be cracked or fractured. As a result, the life of the abutment member 21 is shortened.

Figure 11:
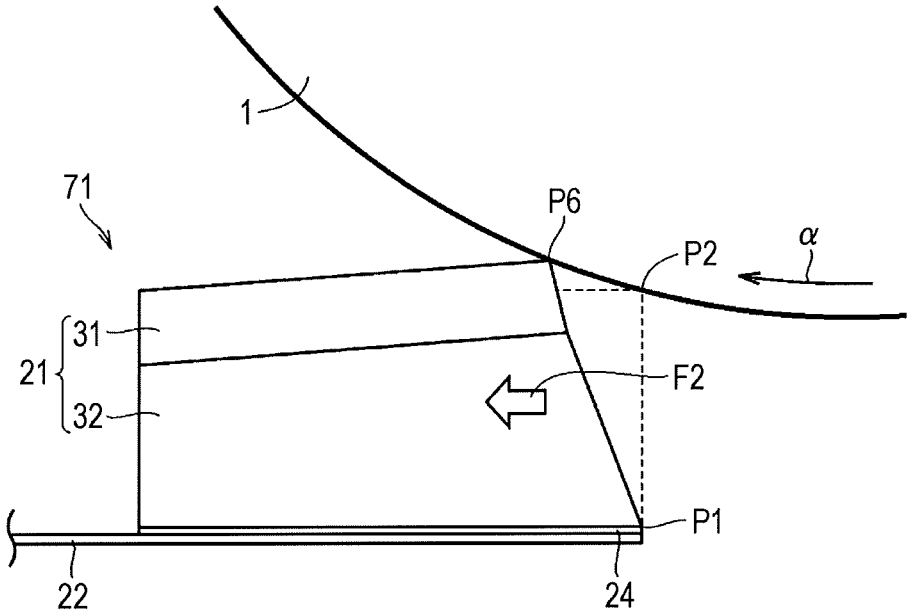
FIG. 11 is a view schematically illustrating a pulled amount of the cleaning blade according to the embodiment of the present invention.
Figure 12:
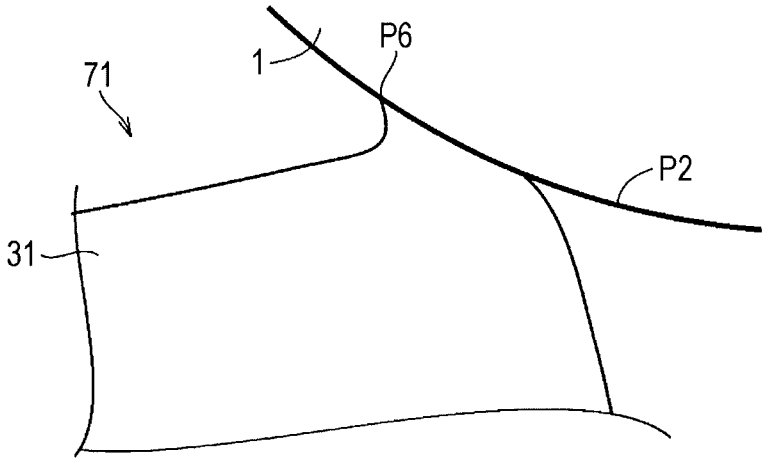
FIG. 12 is an enlarged view of the edge of an abutment member in the cleaning blade illustrated in FIG. 11.

FIG. 11 is a view schematically illustrating the pulled amount of the cleaning blade 71 according to the embodiment of the present invention. FIG. 12 is an enlarged view of the edge of the abutment member 21 in the cleaning blade 71 illustrated in FIG. 11.

Referring to FIGS. 11 and 12, in the cleaning blade 71 according to the present embodiment, unevenness in abutment pressure caused by unevenness in the height H is suppressed by the adjustment layer 32. In other words, an elongation percentage of the adjustment layer 32 is larger than an elongation percentage of the abutment layer 31 in a case where frictional force is applied from the photoreceptor 1 to the abutment member 21 during rotation of the photoreceptor 1. Therefore, even when the adjustment layer 32 is restrained by the supporting member 22 at a position P1, the adjustment layer 32 can be elongated by a sufficient length. The edge of the abutment member 21 is pulled from a position P2 to a position P6 by rotation of the photoreceptor 1, and the pulled amount of the edge of the abutment member 21 (distance from the position P2 to the position P6) by rotation of the photoreceptor 1 can be increased. As a result, even when the height H of the cleaning blade 71 is uneven, the unevenness in the abutment pressure can be suppressed. Additionally, since the unevenness in the abutment pressure is suppressed, non-uniformity in density and cleaning failure caused by non-uniformity in wear of the photoreceptor 1 can be suppressed. Furthermore, since the elongation percentage of the abutment layer 31 is small, it is possible to suppress crack and fracture of the edge of the abutment member 21 caused by accumulation of fatigue in the abutment layer 31. As a result, the life of the abutment member 21 can be improved. Furthermore, since the abutment member 21 is supported by the supporting member 22 that is the separate member, permanent distortion of the cleaning blade 71 can be suppressed.

Particularly, since the thickness t2 in the lamination direction of the adjustment layer 32 is thicker than the thickness t1 in the lamination direction of the abutment layer 31 as illustrated in FIG. 4, an easily-elongated region in the abutment member 21 is increased, and therefore, the unevenness in the abutment pressure can be effectively suppressed.

[Characteristics of Abutment Layer and Adjustment Layer]

Next, characteristics of the abutment layer and the adjustment layer in the present embodiment will be described.

Figure 13:
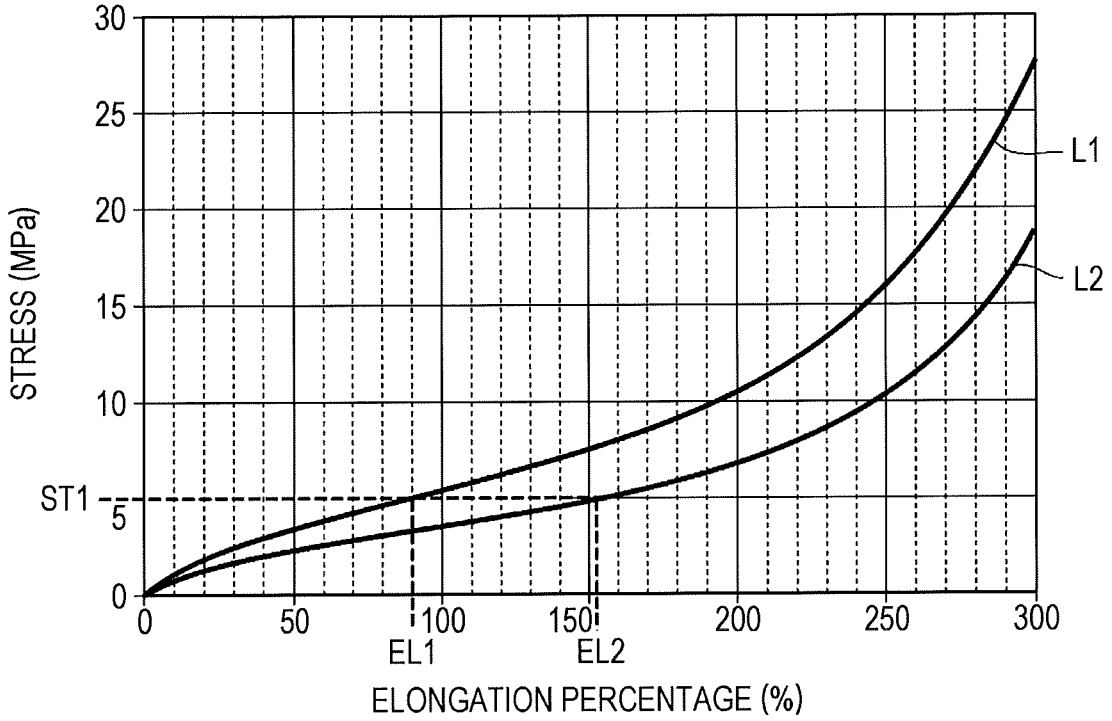
FIG. 13 is a graph illustrating respective stress-strain (SS) characteristics of an abutment layer and an adjustment layer and elongation percentages EL1 and EL2 in a case where stress ST1 is applied in the embodiment of the present invention.

FIG. 13 is a graph illustrating respective stress-strain (SS) characteristics of the abutment layer 31 and the adjustment layer 32 and elongation percentages EL1 and EL2 in a case where stress ST1 is applied in the embodiment of the present invention. Note that a line L1 represents the SS characteristic of the abutment layer 31, and a line L2 represents the SS characteristic of the adjustment layer 32 in FIGS. 13 to 16.

Referring to FIG. 13, in a case where frictional force is applied from the photoreceptor 1 to the abutment member 21 during rotation of photoreceptor 1, the stress ST1 is applied to the abutment member 21. The elongation percentage EL2 of the adjustment layer 32 in the case where the stress ST1 is applied is larger than the elongation percentage EL1 of the abutment layer 31. The stress ST1 is normally several MPa although the stress is changed by specifications, a use state, a use environment, and the like of the cleaning blade 71.

Figure 14:
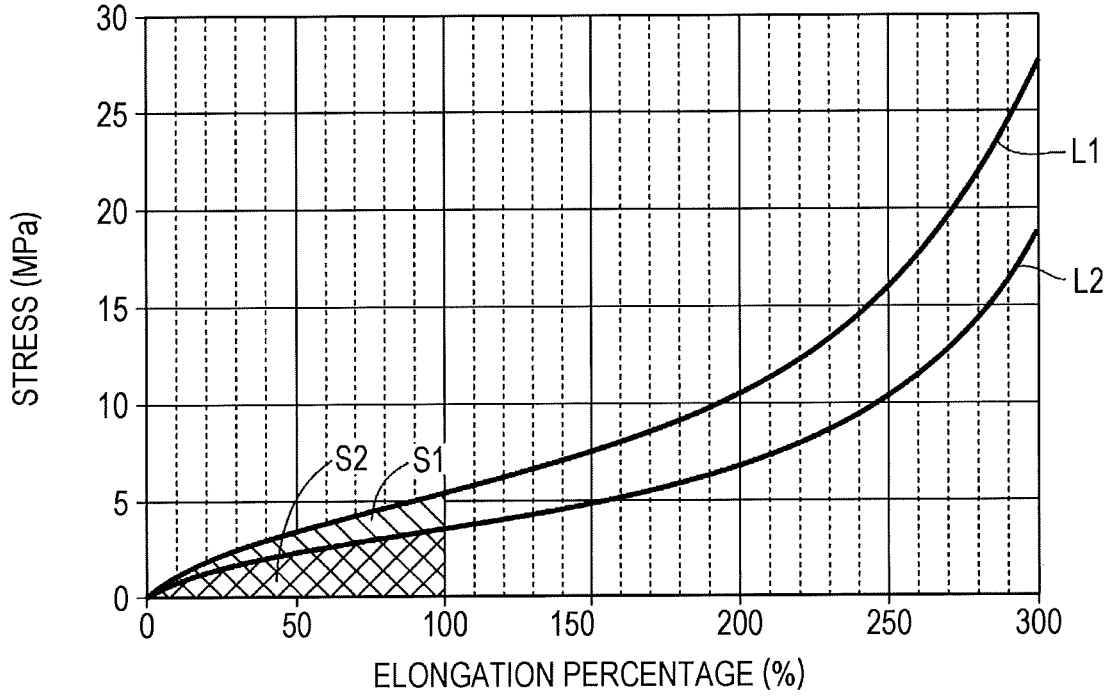
FIG. 14 is a graph illustrating the respective SS characteristics of the abutment layer and the adjustment layer and integrated values S1 and S2 of tensile stress required to elongate a length with the elongation percentage 0% to a length with the elongation percentage 100% in the embodiment of the present invention.

FIG. 14 is a graph illustrating the respective SS characteristics of the abutment layer 31 and the adjustment layer 32 and integrated values Si and S2 of tensile stress required to elongate a length with an elongation percentage 0% to a length with an elongation percentage 100% in the embodiment of the present invention.

Referring to FIG. 14, the integrated value S2 of the tensile stress required to elongate the adjustment layer 32 from the length with the elongation percentage 0% to the length with the elongation percentage 100% is preferably lower than the integrated value Si of the tensile stress required to elongate the abutment layer 31 from the length with the elongation percentage 0% to the length with the elongation percentage 100% With these integrated values, the adjustment layer 32 is more easily elongated than the abutment layer 31 within a range of 0 to 100% that is the range of normal elongation percentage.

Figure 15:
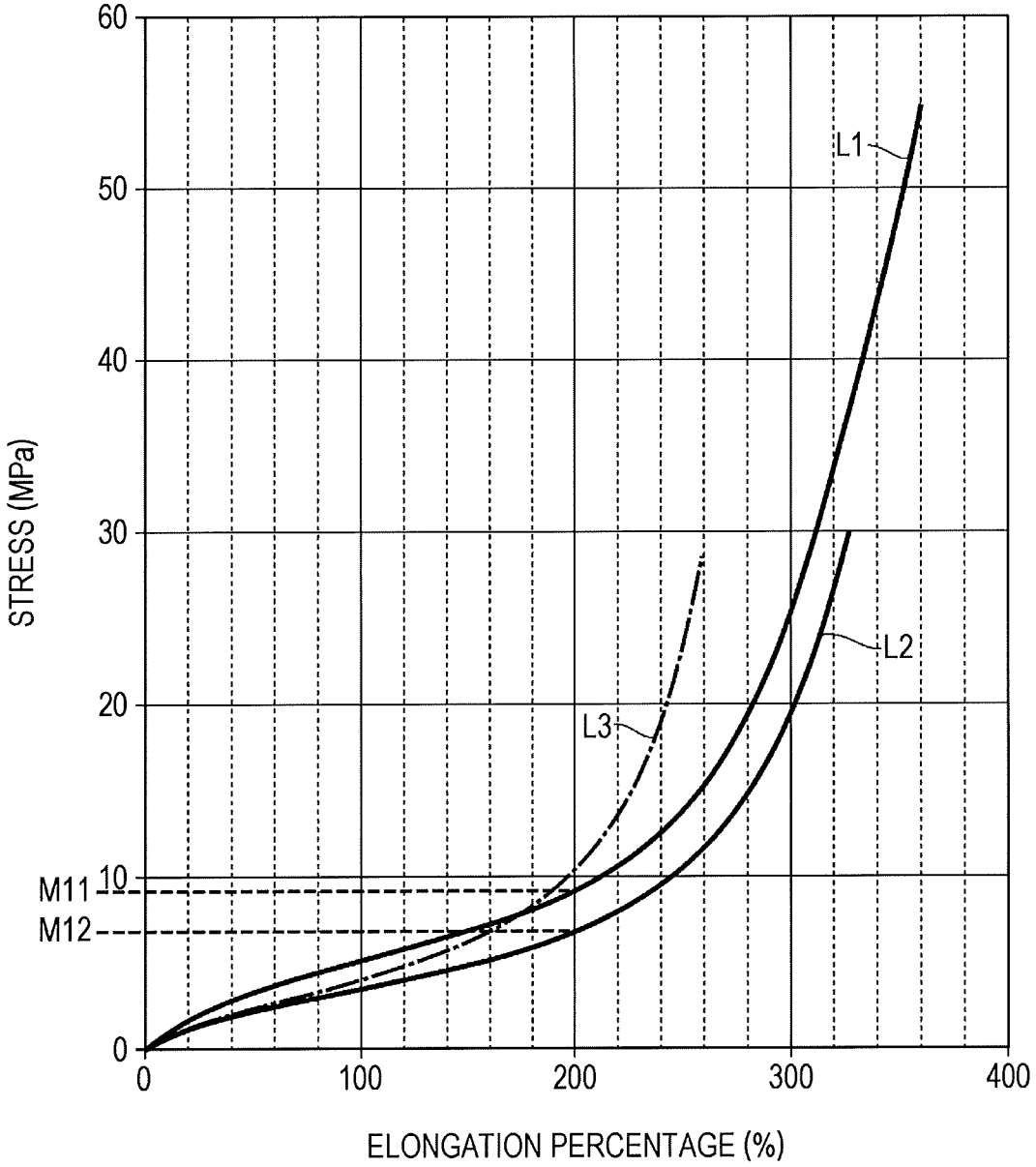
FIG. 15 is a graph illustrating the respective SS characteristics of the abutment layer and the adjustment layer and 200% moduli M11 and M12 in the embodiment of the present invention.

FIG. 15 is a graph illustrating the respective SS characteristics of the abutment layer 31 and the adjustment layer 32 and 200% moduli M11 and M12 in the embodiment of the present invention.

Referring to FIG. 15, the 200% modulus represents force required to elongate a material from a length with an elongation percentage 0% to a length of an elongation percentage 200%. The 200% modulus M12 of the adjustment layer 32 is preferably lower than the 200% modulus M11 of the abutment layer 31. In the event of abnormality, strong force may be locally or entirely applied to the abutment member 21. Since the 200% moduli M11 and M12 of the abutment layer 31 and the adjustment layer 32 have the above-described relation, in the case where strong force is applied to the abutment member 21, it is possible to prevent a situation in which the elongation percentage of the abutment layer 31 becomes larger than the elongation percentage of the adjustment layer 32 (situation in which the adjustment layer 32 has a characteristic as indicated by a line L3 in FIG. 15), and furthermore, it is possible to suppress crack and fracture of the edge of the abutment member 21 caused by accumulation of fatigue in the abutment layer 31.

Figure 16:
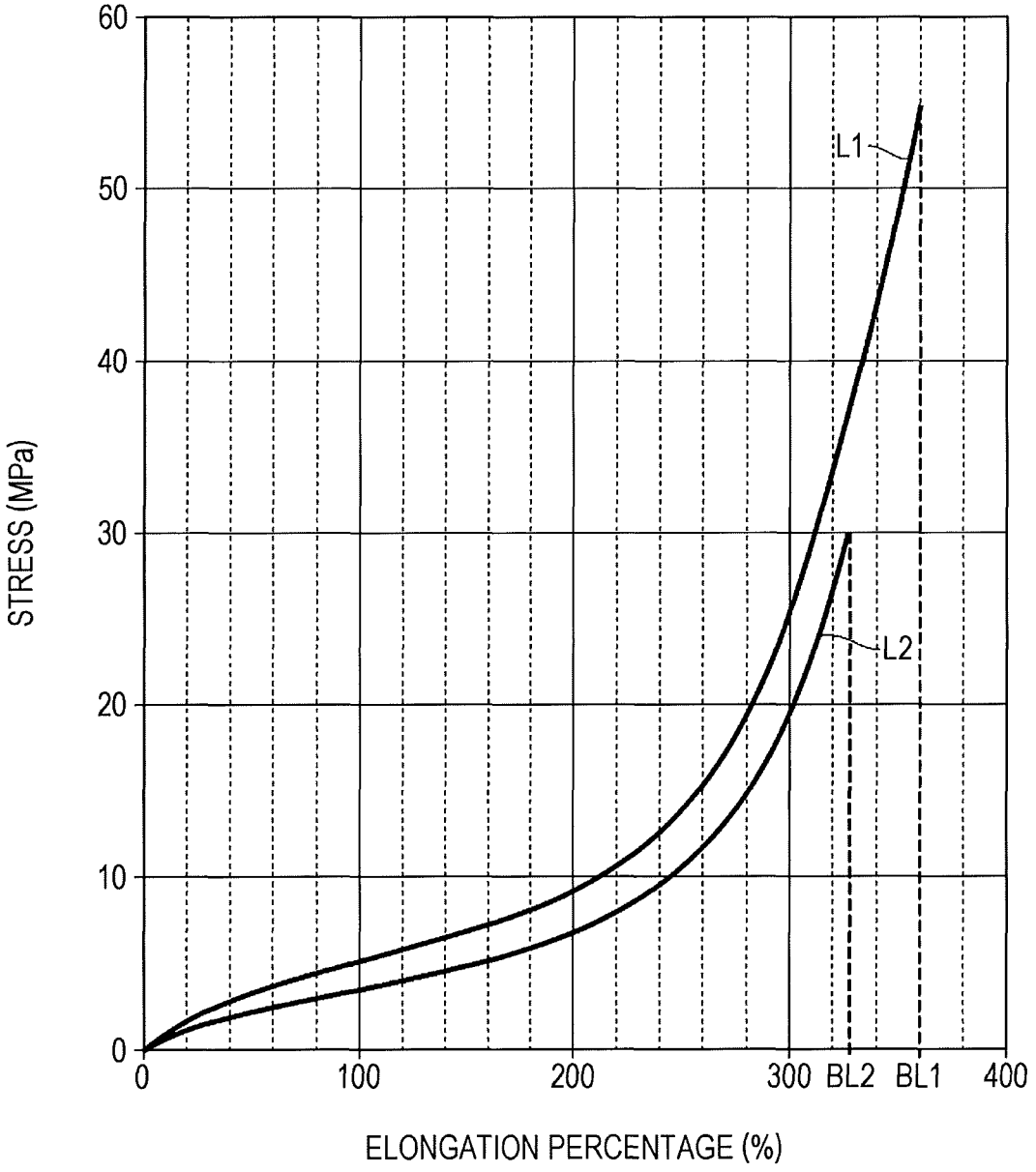
FIG. 16 is a graph illustrating the respective SS characteristics of the abutment layer and the adjustment layer and elongation after fracture BL1 and elongation after fracture BL2 in the embodiment of the present invention.

FIG. 16 is a graph illustrating the respective SS characteristics of the abutment layer 31 and the adjustment layer 32 and elongation after fracture BL1 and elongation after fracture BL2 in the embodiment of the present invention.

Referring to FIG. 16, it is preferable that the elongation after fracture BL1 of abutment layer 31 is larger than the elongation after fracture BL2 of adjustment layer 32. The elongation after fracture is an elongation percentage when a material is fractured, and differs from ease of elongation. In the case where strong force is applied to the abutment member 21, mainly the adjustment layer 32 is elongated and a load applied to the abutment layer 31 is reduced in the present embodiment. Since the elongation after fracture BL1 of the abutment layer 31 and elongation after fracture BL2 of the adjustment layer 32 have the above-described relation, tensile strength of the abutment layer 31 becomes stronger and the abutment layer 31 is hardly fractured even in the case where the strong force is applied to the abutment member 21.

FIRST PRACTICAL EXAMPLE

The inventor of the present application conducted following tests to evaluate performance of the cleaning blade of the present invention.

FIG. 17 is a table illustrating structures and verification results of Examples 1 to 5 of the present invention in a first practical example of the present invention and Comparative Examples 1 to 5. FIG. 18 is a table illustrating various conditions in the first practical example of the present invention.

Referring to FIGS. 17 and 18, ten types of cleaning blades including Examples 1 to 5 of the present invention and Comparative Examples 1 to 5 were prepared, and verifications 1 to 5 were conducted. Each of Examples 1 to 5 of the present invention had the structure illustrated in FIG. 4 and was an example in which an adjustment layer had an elongation percentage larger than an elongation percentage of an abutment layer relative to same force. Comparative Examples 1 and 2 were examples in which an adjustment layer had an elongation percentage smaller than an elongation percentage of an abutment layer relative to same force. Each of Comparative Examples 3 and 4 had the structure illustrated in FIG. 5, and was an example in which an abutment member including only one layer was supported by a supporting member. Comparative Example 5 had the structure illustrated in FIG. 8, and was an example (conventional cleaning blade made of only urethane rubber) in which an abutment member was not supported by a supporting member. A free length of the abutment member in Comparative Example 5 is 10 mm.

A drum unit (unit including a photoreceptor) in an MFP having a product name "bizhub C284e" manufactured by Konica Minolta was prepared. Additionally, as a cleaning blade of a photoreceptor cleaner of this drum unit, each of the above-described ten types of cleaning blades was used. In the verification 2, an organic photoreceptor not including a high-hardness protective layer for the purpose of long life was used as a photoreceptor of the drum unit in order to accurately evaluate non-uniformity in wear. Other conditions in the tests were shown in FIG. 18. Note that the free length in FIG. 18 is a distance from a position to be a fulcrum of deformation of the supporting member in the holding member to a leading end of the abutment member fixed to the supporting member.

For each of the above-described ten types of cleaning blades, five verifications shown in FIG. 17 were conducted.

The verification 1 was a pulled amount measurement. In the verification 1, each of the cleaning blades was installed in the drum unit in which a friction coefficient was set at a constant value. The photoreceptor was driven at a speed of 165 mm/s, and then a moved distance from an abutment position during a stopped state was measured by photographing an abutment position between the cleaning blade and the photoreceptor with a camera from the extending direction of the rotational shaft of the photoreceptor being currently driven, and the measured value is determined as a pulled amount.

In the case where the pulled amount was extremely large (in a case of being equivalent to a pulled amount of the conventional cleaning blade made of only urethane in FIG. 8), specifically, in a case where the pulled amount was 100 μm or more), evaluation was "excellent (A)", in a case where the pulled amount was large (in a case of being larger a pulled amount of the cleaning blade (FIG. 5) in which the conventional abutment member including only one layer was supported by the supporting member), evaluation was "good (B)", and in a case where a pulled amount was small (in a case of being almost equivalent to the pulled amount of the cleaning blade (FIG. 5) in which the conventional abutment member including only one layer was supported by the supporting member), evaluation was "poor (F)".

As results of the verification 1, evaluation was "A" or "B" in all of all of Examples 1 to 5 of the present invention. In Comparative Example 4, evaluation was "A" because the abutment member made of a material easily elongated was adopted. In Comparative Example 5, the pulled amount was increased to 152 μm (about 120 μm depending on a condition) and evaluation was "A" because the abutment member was not supported by the supporting member. On the other hand, in Comparative Examples 1 and 2, since the abutment member was made of a material that can be hardly elongated, the pulled amount was small like approximately 50 μm that was almost equivalent to a pulled amount of the cleaning blade (Comparative Example 3) in which the conventional abutment member including only one layer was supported by the supporting member.

The verification 2 was evaluation on non-uniformity in wear. In the verifications 2 to 4, durability test was conducted in advance by printing characters and image charts with a print percentage of 5% on one hundred thousand pieces of sheets in an intermittent mode in a normal environment (temperature 23° C. and humidity 65%).

In the verification 2, a wear amount in a region having a length of 10 mm in the longitudinal direction of the photoreceptor was measured after the above durability test. In a case where a difference in the wear amount (wear difference) in this region was less than 3 μm, evaluation was "B", and in a case where difference was 3 μm or more, evaluation was "F". The reason was that: when the difference of 3 μm or more is generated in the region having the length of 10 mm in the longitudinal direction of the photoreceptor, non-uniformity in density was visually confirmed in a printed image.

As a result of the verification 2, evaluation was "A" in all of Examples 1 to 5 of the present invention. In Comparative Example 4 also, evaluation was "B" because of the large pulled amount. Meanwhile, in Comparative Example 5, evaluation was "B" because the abutment member was not supported by the supporting member, and there was no problem of non-uniformity in wear. On the other hand, in Comparative Examples 1 to 3, evaluation was "F" because the pulled amount was small.

The verification 3 was evaluation on cleaning performance. In the verification 3, a cleaning blade was taken out from the drum unit after the durability test, and was installed in a new drum unit. A large amount of residual toner was made to adhere onto (remain on) the photoreceptor by developing an image with a print percentage of 100% on the photoreceptor and performing printing while suppressing a transfer rate onto the intermediate transfer belt in an environment having a low temperature and a low humidity (temperature of 10° C. and humidity of 15%). An amount of the toner adhering to the photoreceptor was changed in a range of 0 to 3 $g/m^2$. An image printed on a sheet was visually checked. In a case where no streak appears due to incomplete wiping by the cleaning blade, evaluation was "B", and in a case where a streak appears due to incomplete wiping by the cleaning blade, evaluation was "F".

As a result of the verification 3, evaluation was "B" in all of Examples 1 to 5 of the present invention. Evaluation was "F" in all of Comparative Examples 1 to 5. Particularly, in Comparative Examples 1 to 3, the streaks appeared due to incomplete wiping at a position included in an image and corresponding to a region where the abutment pressure of the cleaning blade applied to the photoreceptor was decreased due to unevenness in the abutment pressure. In Comparative Example 4, the edge of the abutment member was damaged, and a streak due to incomplete wiping appeared at a position included in an image corresponding to a region where the edge was damaged. In Comparative Example 5, a streak due to incomplete wiping by the cleaning blade appeared in an entire image because the abutment pressure of the cleaning blade applied to the photoreceptor was decreased due to a damage at the edge of the abutment member and permanent distortion of the abutment member.

The verification 4 was evaluation on presence/absence of a damage of the cleaning blade under severe conditions. In the verification 4, an additional durability test was conducted under more severe conditions after the above durability test, and the presence/absence of a damage at a leading end of each cleaning blade (leading end of each abutment member) was evaluated. In the additional durability test, printing was performed on fifty thousand pieces of sheets while increasing the number of intermittent times in an environment having a low temperature and a low humidity (temperature 10° C. and humidity 15%) and an environment having a high temperature and a high humidity (temperature 30° C. and humidity 85%). In a case where the leading end of the cleaning blade was not damaged by only normal abrasion after the additional durability test, evaluation was "B", in a case where the leading end of the cleaning blade was not damaged after the durability test and the leading end of the cleaning blade was damaged after the additional test, evaluation was "fair (C)", and in a case where the leading end of the cleaning blade was damaged before the additional durability test, evaluation is provided as "F".

As a result of the verification 4, evaluation was "B" in Examples 1, 4, and 5 of the present invention. In Examples 2 and 3 of the present invention, evaluation was "C" because elongation after fracture of the abutment layer was smaller than elongation after fracture of the adjustment layer. The elongation after fracture was elongation at the time of damage, and it was found that: when the elongation after fracture of the abutment layer was small, the edge of the abutment layer was damaged under the severe conditions. In Comparative Examples 1 to 3, evaluation was "B". In Comparative Examples 4 and 5, evaluation was "F", and the edge of the abutment member was already damaged before conducting the additional durability test.

The verification 5 was evaluation on permanent distortion. In the verification 5, the cleaning blade was installed in the drum unit under setting conditions illustrated in FIG. 18, and the cleaning blade was left for 1000 hours in an environment having a high temperature and a high humidity (temperature 30° C. and humidity 85%). After being left for the mentioned period, the abutment pressure of the cleaning blade to the photoreceptor was measured, and a decreased amount of the abutment pressure during a period before and after being left was calculated. In a case where the decreased amount of the abutment pressure was smaller than a predetermined value, evaluation was "B", and in a case where the decreased amount of the abutment pressure was larger than the predetermined value, evaluation was "F".

As a result of the verification 5, there was no permanent distortion and evaluation was "B" in Examples 1 to 5 of the present invention and Comparative Examples 1 to 4 because the abutment member was supported by the supporting member. In Comparative Example 5, evaluation was "F" because the abutment member was not supported by the supporting member. From the above, it was found that there was no permanent distortion and the abutment pressure was not decreased because the abutment member was supported by the supporting member.

Meanwhile, referring the results of Examples 1 and 2 of the present invention, it was found that hardness and a Young's modulus of each of the abutment layer and the adjustment layer hardly affected the results of verifications 1 to 3.

SECOND PRACTICAL EXAMPLE

The inventor of the present application conducted following tests to evaluate performance of the cleaning blade of the present invention.

Figure 19:
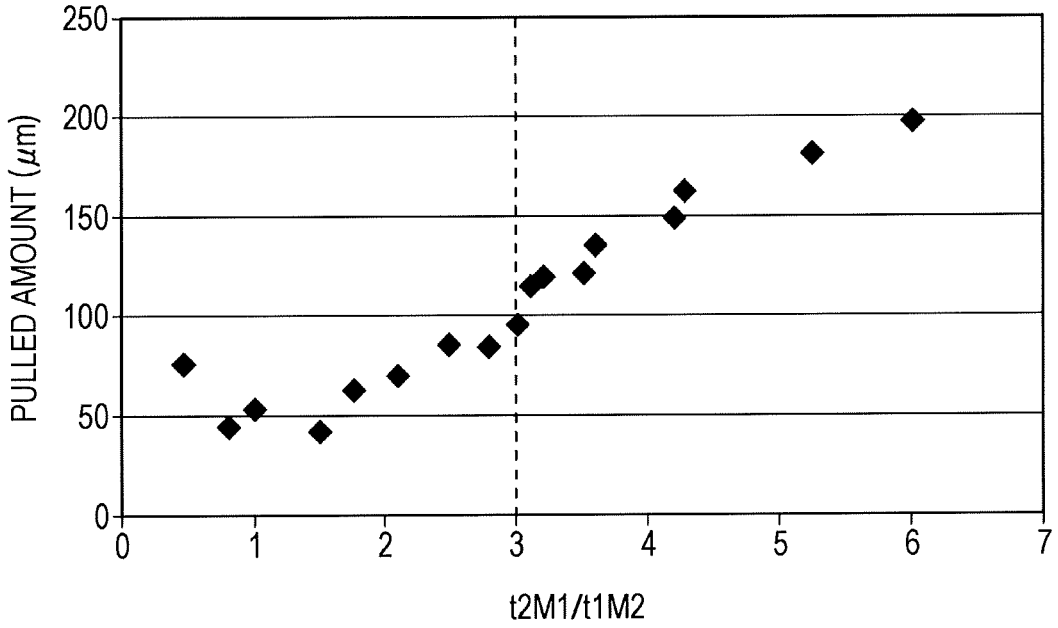
FIG. 19 is a graph illustrating a relation between a value of (t2×M1)/(t1×M2) and a pulled amount in a second practical example of the present invention.

FIG. 19 is a graph illustrating a relation between a value of (t2×M1)/(t1×M2) and a pulled amount in a second practical example of the present invention.

Referring to FIG. 19, in a case of defining a thickness that is a length of the abutment layer in the lamination direction as a thickness t1, defining a thickness that is a length of the adjustment layer in the lamination direction of the adjusting layer as a thickness t2, defining a 100% modulus of the abutment layer as a modulus M1, and defining a 100% modulus of the adjustment layer as a modulus M2, many cleaning blades having different values of (t2×M1)/(t1×M2) were prepared. All of the prepared cleaning blades were examples of the present invention (having the structure illustrated in FIG. 4, in which the adjustment layer had an elongation percentage larger than an elongation percentage of the abutment layer relative to the same force). For each of the prepared cleaning blades, a pulled amount was measured in a method similar to that in the verification 1 of the first practical example.

When a value of (t2×M1)/(t1×M2) was larger than 3 as a result of measurement of a pulled amount, the pulled amount was particularly large, and an effect of suppressing unevenness in the abutment pressure was higher.

[Modified Examples of Cleaning Blade]

FIGS. 20A to 20D are cross-sectional views illustrating structures of modified examples of the cleaning blade 71 according to the embodiment of the present invention.

Referring to FIGS. 20A to 20D, the abutment member 21 of the cleaning blade 71 of the present embodiment may have following structures besides the structure illustrated in FIG. 4. In the abutment member 21 illustrated in FIG. 20A, both of the abutment layer 31 and the adjustment layer 32 are fixed to the supporting member 22, and the abutment layer 31 surrounds an upper surface and a part of side surfaces of the adjustment layer 32. The adjustment layer 32 is provided only in the vicinity of a position P1 of an end on the leading end side of the abutment member 21.

Figure 20A:
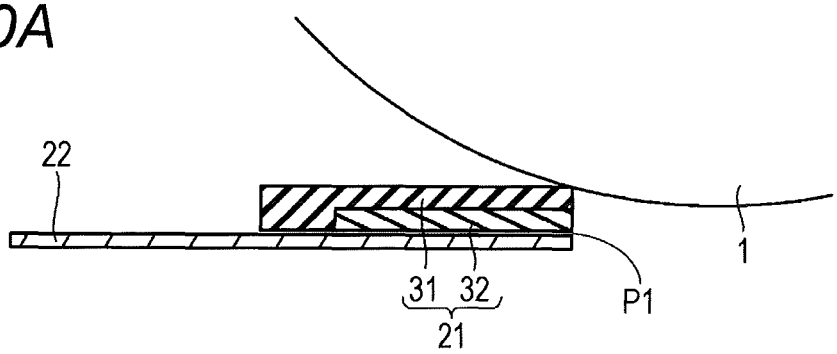
FIGS. 20A to 20D are cross-sectional views illustrating structures of modified examples of the cleaning blade according to the embodiment of the present invention.
Figure 20B:
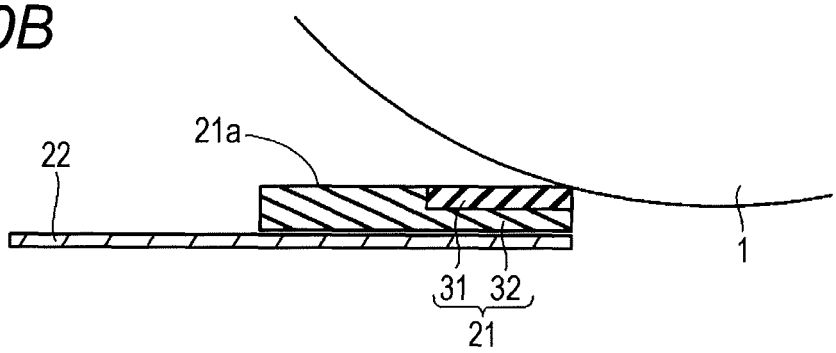

In the abutment member 21 illustrated in FIG. 20B, the adjustment layer 32 constitutes a part of the upper surface 21*a* of the abutment member 21 and surrounds a lower surface and a part of side surfaces of the abutment layer 31. The abutment layer 31 is provided only in the vicinity of the edge of the abutment member 21.

Figure 20C:
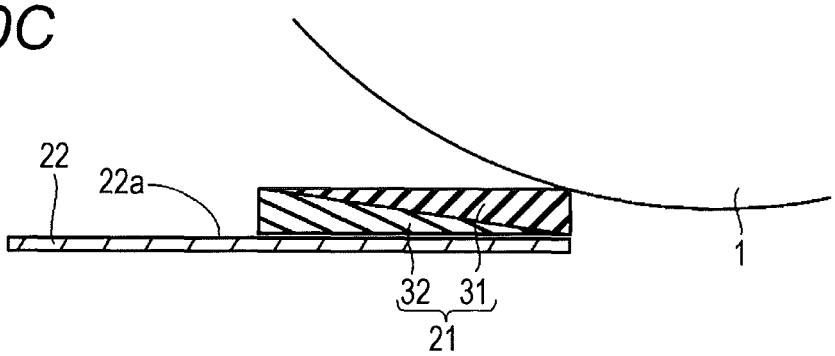

In the abutment member 21 illustrated in FIG. 20C, the abutment layer 31 and the adjustment layer 32 are laminated in a direction inclined with respect to the upper surface 22*a* of the supporting member 22 (direction from lower left to an upper right in FIGS. 20A to 20D).

Figure 20D:
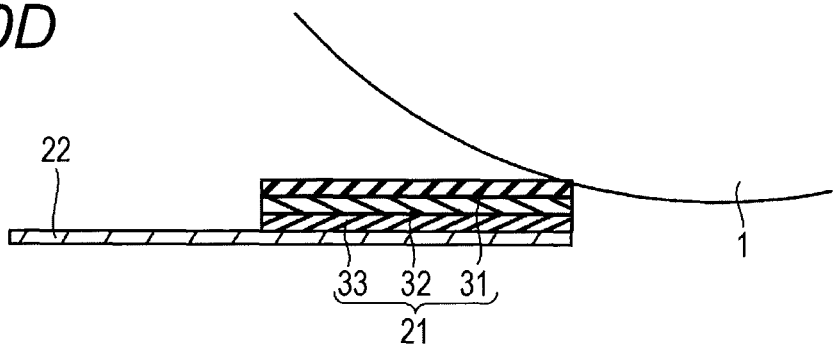

The abutment member 21 illustrated in FIG. 20D further includes an underlayer 33 in addition to the abutment layer 31 and the adjustment layer 32. The underlayer 33 is fixed to the supporting member 22. The adjustment layer 32 is provided on an upper surface of the underlayer 33 and is not fixed to the supporting member 22.

[Others]

A relation between hardness of the abutment layer 31 and hardness of the adjustment layer 32 is arbitrary. In a case where the hardness of the adjustment layer 32 is lower than the hardness of the abutment layer 31, unevenness in the height of the abutment member 21 can be easily reduced at the time of fixing the abutment member 21 by using a bonding agent. In a case where the hardness of the abutment layer 31 is lower than the hardness of the adjustment layer 32, abrasion resistance of the abutment member 21 can be improved. Similarly, a relation between a Young's modulus of the abutment layer 31 and a Young's modulus of the adjustment layer 32 is arbitrary.

The cleaning blade 71 in the above-described embodiment may be mounted not only on the photoreceptor cleaner 7 that removes a matter adhering to the photoreceptor 1, and may also be mounted on the intermediate transfer belt cleaner 9 that removes a matter adhering to the intermediate transfer belt 5.

Although embodiments and practical examples of the present invention have been described and illustrated in detail, it should be considered that the disclosed embodiments and practical examples are made for purposes of illustration and example only and not limitation in all respects. The scope of the present invention should be interpreted not by the above description but by terms of the appended claims, and is intended to include meanings equivalent to the scope of claims as well as all of changes within the scope of the claims.

What is claimed is:

1. A cleaning blade that removes a foreign matter adhering to a rotational body, comprising:

an abutment member;

a supporting member that supports the abutment member; and a holding member that holds the supporting member, wherein the abutment member includes:

an abutment layer abutting on the rotational body; and an adjustment layer that is a part other than the abutment layer, and an elongation percentage of the adjustment layer is larger than an elongation percentage of the abutment layer in a case where frictional force is applied from the rotational body to the abutment member during rotation of the rotational body.

2. The cleaning blade according to claim 1, wherein an integrated value of tensile stress required to elongate the adjustment layer from a length with an elongation percentage 0% to a length with an elongation percentage 100% is lower than an integrated value of tensile stress required to elongate the abutment layer from a length with an elongation percentage 0% to a length with an elongation percentage 100%.

3. The cleaning blade according to claim 1, wherein a 200% modulus of the adjustment layer is lower than a 200% modulus of the abutment layer.

4. The cleaning blade according to claim 1, wherein elongation after fracture of the abutment layer is larger than elongation after fracture of the adjustment layer.

5. The cleaning blade according to claim 1, wherein the abutment layer and the adjustment layer are laminated in a predetermined lamination direction.

6. The cleaning blade according to claim 5, wherein in a case of defining a thickness of the abutment layer in the lamination direction as a thickness t1 and defining a thickness of the adjustment layer in the lamination direction as a thickness t2, the thicknesses t1 and t2 have a relation of $t1<t2$.

7. The cleaning blade according to claim 5, wherein in a case of defining a thickness that is a length of the abutment layer in the lamination direction as a thickness t1, defining a thickness that is a length of the adjustment layer in the lamination direction as a thickness t2, defining a 100% modulus of the abutment layer as a modulus M1, and defining a 100% modulus of the adjustment layer as a modulus M2, the thicknesses t1, t2 and the moduli M1 and M2 have a relation of $(t2\times M1)/(t1\times M2)>3$.

8. The cleaning blade according to claim 5, wherein the adjustment layer is arranged on a side closer to the supporting member than the abutment layer is, and the adjustment layer is bonded to the supporting member.

9. The cleaning blade according to claim 1, wherein a Young's modulus of the supporting member is 98 GPa or more and 206 GPa or less.

10. The cleaning blade according to claim 1, wherein the supporting member is constituted of a metallic leaf spring, and the holding member is constituted of a sheet metal.

11. The cleaning blade according to claim 1, wherein a thickness of the supporting member is larger than 0 and 100 μm or less.

12. The cleaning blade according to claim 1, wherein the holding member holds one end of the supporting member, and the abutment member is fixed to a different end of the supporting member.

13. The cleaning blade according to claim 12, wherein the holding member includes: a first holding member surface located on a side where the abutment member abuts on the rotational body; and a second holding member surface located on an opposite side of the first holding member surface, the supporting member includes: a first supporting member surface located on a side of a position where the abutment member abuts on the rotational body; and a second supporting member surface located on an opposite side of the first supporting member surface and facing the first holding member surface, and the abutment member is fixed to the first supporting member surface.

14. The cleaning blade according to claim 1, wherein the adjustment layer is fixed to the supporting member, and the abutment layer is not fixed to the supporting member.

15. An image forming apparatus comprising:

an image carrier that is a rotational body; and a cleaning blade according to claim 1 that removes a foreign matter adhering to the image carrier.

* * * * *